US009156064B2

(12) United States Patent
Koehler et al.

(10) Patent No.: US 9,156,064 B2
(45) Date of Patent: Oct. 13, 2015

(54) APPARATUS AND METHOD FOR SORTING PLANT MATERIAL

(75) Inventors: Klaus L. Koehler, Westfield, IN (US); Gary Tragesser, West Lafayette, IN (US); Mark Swanson, Fowler, IN (US)

(73) Assignee: Dow AgroSciences LLC, Indianapolis, IN (US)

( * ) Notice: Subject to any disclaimer, the term of this patent is extended or adjusted under 35 U.S.C. 154(b) by 0 days.

(21) Appl. No.: 13/555,953

(22) Filed: Jul. 23, 2012

(65) Prior Publication Data

US 2012/0296468 A1 Nov. 22, 2012

Related U.S. Application Data

(63) Continuation of application No. 12/707,160, filed on Feb. 17, 2010, now Pat. No. 8,253,054.

(51) Int. Cl.
*B07C 5/00* (2006.01)
*B07C 5/342* (2006.01)

(52) U.S. Cl.
CPC ..... *B07C 5/342* (2013.01)

(58) Field of Classification Search
CPC ..... B07C 5/342; G06T 2207/30044
USPC ..... 209/576, 577, 580, 581, 939; 382/110; 700/223, 228
See application file for complete search history.

(56) References Cited

U.S. PATENT DOCUMENTS 3,880,289 A 4/1975 Gray
5,321,764 A * 6/1994 Cullen et al. ..... 382/110
5,703,784 A 12/1997 Pearson
5,835,206 A * 11/1998 Tragesser ..... 356/72
5,973,286 A 10/1999 Wan
6,427,128 B1 7/2002 Satake et al.
6,729,249 B2 5/2004 Sauder et al.
6,947,144 B2 9/2005 Kim et al.
7,111,740 B2 9/2006 Ogawa et al.
7,339,660 B1 3/2008 Cohn
7,367,155 B2 * 5/2008 Kotyk et al. ..... 47/14
7,600,642 B2 10/2009 Deppermann
7,851,722 B2 12/2010 Ito et al.
7,998,669 B2 8/2011 Deppermann et al.
8,031,910 B2 10/2011 Jones et al.
8,189,901 B2 * 5/2012 Modiano et al. ..... 382/141
8,253,054 B2 8/2012 Koehler (Continued)

FOREIGN PATENT DOCUMENTS

WO WO 2006/072590 7/2006
WO WO 2008/150798 12/2008

OTHER PUBLICATIONS

"It takes Billions of Pixels per second to evaluate the Neuro-RAM Hierarchies," Sightech Vision Systems, Inc., 2005 (6 pages).

(Continued)

*Primary Examiner* — Joseph C Rodriguez
(74) *Attorney, Agent, or Firm* — C. W. Arnett; Faegre Baker Daniels LLP

(57) ABSTRACT

An apparatus and method for sorting plant material based on the presence or absence of a visual marker on the plant material. The visible marker may be a visible genetic color marker in the corn seed which is used in double haploid breeding. The absence or presence of the visible marker identifies correctly pollinated seeds as well as putative haploid seeds.

27 Claims, 15 Drawing Sheets

(56) References Cited

U.S. PATENT DOCUMENTS

| | | | | |
|---|---|---|---|---|
| 2003/0112440 | A1 | 6/2003 | Fukumori et al. | |
| 2005/0226465 | A1* | 10/2005 | Fujita et al. | 382/110 |
| 2009/0032441 | A1 | 2/2009 | Corak et al. | |
| 2010/0269212 | A1 | 10/2010 | VanOpdorp et al. | |
| 2012/0303157 | A1* | 11/2012 | Chung | 700/223 |

OTHER PUBLICATIONS

"Real World Objects—Animals See the World in Terms of Objects—not Pixels," Sightech Vision Systems, Inc., 2005 (7 pages).
"Neuro-RAM—How Hierarchies Facilitate Effective Product Inspection and Decision Making," Sightech Vision Systems, Inc., 2005 (6 pages).
"PC-Eyebot—Learning Modes Explained—Feature Types and Sizes," Sightech Vision Systems, Inc., 2005 (8 pages).
"PC-Eyebot—Learning Modes Explained—Feature Fixtured Options," Sightech Vision Systems, Inc., 2005 (5 pages).
"PC-Eyebot—Learning Modes Explained—Feature Memory Choices," Sightech Vision Systems, Inc., 2005 (3 pages).
"Trainable Vision—How Intelligent Vision Systems View the World," Sightech Vision Systems, Inc., 2005 (4 pages).
"PC-Eyebot—Vision Applications—PC-Eyebot versus Frame Grabbers," Sightech Vision Systems, Inc., 2005 (3 pages).
"PC-Eyebot—Good Applications for PC-Eyebot," Sightech Vision Systems, Inc., 2005 (9 pages).
"PC-Eyebot—Control—Serial Port Commands," Sightech Vision Systems, Inc., 2005 (7 pages).

* cited by examiner

APPARATUS AND METHOD FOR SORTING PLANT MATERIAL

CROSS REFERENCE TO RELATED APPLICATIONS

This application is a continuation of U.S. application Ser. No. 12/707,160, filed on Feb. 17, 2010, the disclosure of which is incorporated by reference herein.

FIELD

The present invention relates to methods and apparatus for sorting plant material based on one or more characteristics of the plant material and in particular to methods and apparatus for sorting bulk seed based on one or more characteristics of the individual seed.

BACKGROUND

The development of new seed varieties is performed by selectively introducing desired characteristics into a plant population. The resultant seeds from the plant population are then examined to identify seeds to be used in further development of the plant variety. Often times a visual marker may be used to identify seeds for use in further development. An exemplary visual marker includes the presence or absence of a given color in the embryo region of the individual seeds. Visual markers may also be used in the identification of other types of plant materials. For example, the color of the root may be used to separate seedlings.

A visible genetic color marker in the corn seed is utilized in double haploid breeding to identify correctly pollinated seeds as well as putative haploid seeds. The male pollinator, or haploid inducer, confers the dark purple color exhibited in the fertilized seed endosperm by passing on the Navajo marker gene rnj. However, the absence of the genetic marker color in the embryo tissue within the seed indicates that no male genes entered the ovule nucleus, leaving the embryo with only one set of chromosomes inherited from the female parent.

Therefore, expression of the color marker in the endosperm tissue, but lack of expression in the embryo, indicates a putative haploid kernel (PHK) which is useful for breeding purposes. Color expression in both regions of the seed indicates a normal diploid kernel with genes from both the male and female parents which has no value for this type of maize breeding.

Current methods of separating PHK kernels from a seed lot is performed using human labor which is both time consuming and relatively expensive. In a typical seed lot about 10 percent of the seed lot are PHK kernels.

SUMMARY

In an exemplary embodiment of the present disclosure, an apparatus for sorting plant material is provided which sorts the plant material based on at least one visual marker. In another exemplary embodiment of the present disclosure, a method of automatically sorting plant material based on at least one visual marker of the plant material is provided.

In yet another exemplary embodiment of the present disclosure, an apparatus for sorting seeds of a seed lot is provided. The apparatus comprises a transport system which supports at least one seed at a time; an imaging system which captures at least one image of an embryo region of the at least one seed; an electronic controller which makes a sorting decision regarding the at least one seed based on the at least one image of the embryo region of the at least one seed; and a sorting system which alters a path of at least one of a first seed and a second seed. The sorting decision having at least two sorting outcomes. The electronic controller associates a first sorting outcome with the first seed and the electronic controller associates a second sorting outcome with the second seed.

In still another exemplary embodiment of the present disclosure, a method for sorting seeds of a seed lot is provided. The method comprising the steps of (a) capturing at least one image of an embryo region of a plurality of seeds; (b) for each seed of the plurality of seeds determining if the embryo region of the seed includes a visual marker; and (c) automatically sorting each seed of the plurality of seeds into one of at least two groups based on the determination made in step (b).

The above mentioned and other features of the invention, and the manner of attaining them, will become more apparent and the invention itself will be better understood by reference to the following description of embodiments of the invention taken in conjunction with the accompanying drawings.

BRIEF DESCRIPTION OF THE DRAWINGS

Corresponding reference characters indicate corresponding parts throughout the several views.

DETAILED DESCRIPTION OF THE DRAWINGS

The embodiments disclosed below are not intended to be exhaustive or to limit the invention to the precise forms disclosed in the following detailed description. Rather, the embodiments are chosen and described so that others skilled in the art may utilize their teachings. While the present disclosure is primarily directed to the sorting of seeds of a seed lot based on at least one visual marker, it should be understood that the features disclosed herein may have application to the sorting of other types of plant materials based on at least one visual marker.

Figure 1:
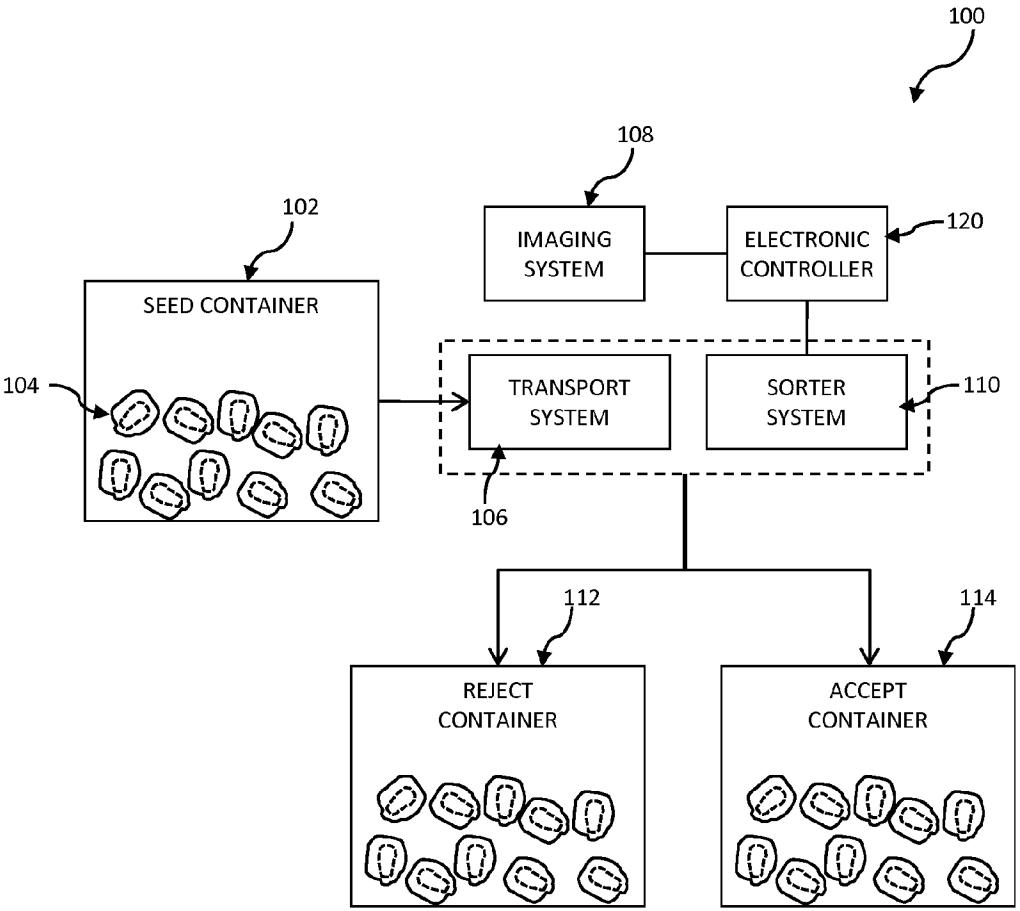
FIG. 1 represents an exemplary sorting apparatus.

Referring to FIG. 1, a seed sorting apparatus 100 is illustrated. Seed sorting apparatus 100 includes a seed container 102 holding a seed lot 104 including a plurality of seed. Seed container 102 may be any suitable container for holding seed. The seed of seed lot 104 is transported by a transport system 106 such that the seed may be imaged by an imaging system 108. Exemplary transport systems 106 include conveyors and other suitable systems for moving the seed. Exemplary imaging systems 108 include cameras and other suitable imaging devices. In the case of a conveyor system, the seed is carried or otherwise supported into the field of view of the imaging system 108 and then carried or otherwise supported out of the field of view of the imaging system 108. In one embodiment, the seed is dropped from a first location above the field of view of the imaging system 108, through the field of view of the imaging system 108, and to a second location outside of the field of view of the imaging system 108.

Seed sorting apparatus 100 further includes a sorting system 110 which directs the seed towards one of a reject container 112 and an accept container 114. Exemplary sorting systems include mechanical systems, pneumatic systems, and other types of systems which may alter the path of the seed. In one embodiment, sorting system 110 directs the seed towards one of reject container 112 and accept container 114. In one embodiment, an additional transport member, such as a chute, may carry the seed to the respective reject container 112 or accept container 114. In one embodiment, transport system 106 and sorting system 110 cooperate to direct the seed towards one of reject container 112 and accept container 114.

Seed sorting apparatus 100 includes an electronic controller 120 which is operatively coupled to the sorting system 110 and which causes the sorting system 110 to direct the seed to one of reject container 112 and accept container 114. An exemplary electronic controller 120 is a computer programmed to make a sorting decision based on at least one image of the seed captured by the imaging system 108. In one embodiment, the sorting decision of electronic controller 120 for a first seed is a first sorting outcome which instructs sorting system 110 to direct the seed towards reject container 112. In one embodiment, the sorting decision of electronic controller 120 for a first seed is a second sorting outcome which instructs sorting system 110 to direct the seed towards accept container 114.

Figure 2:
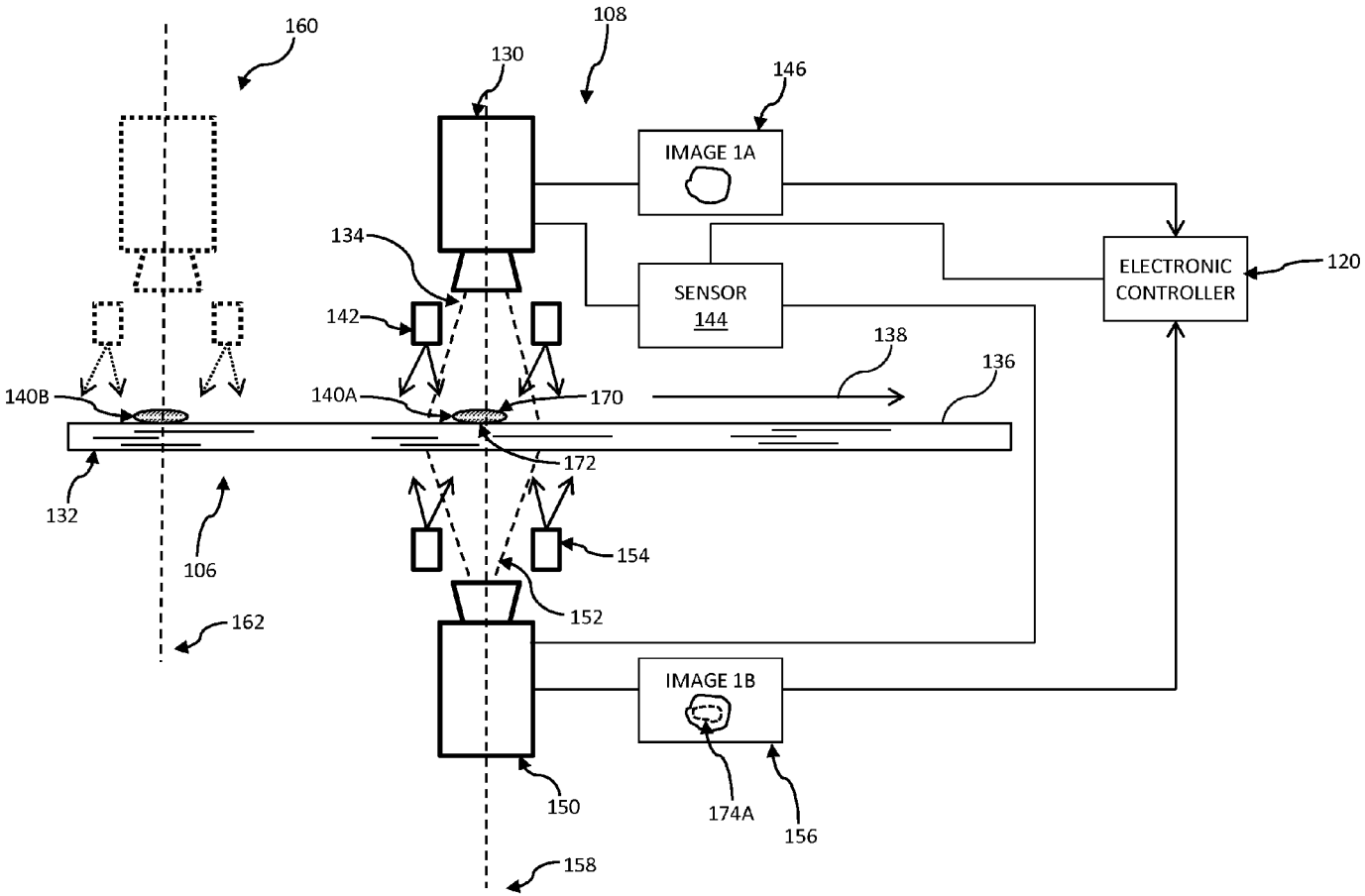
FIG. 2 illustrates an exemplary arrangement of cameras above and below a transport member to image a first seed.
Figure 3:
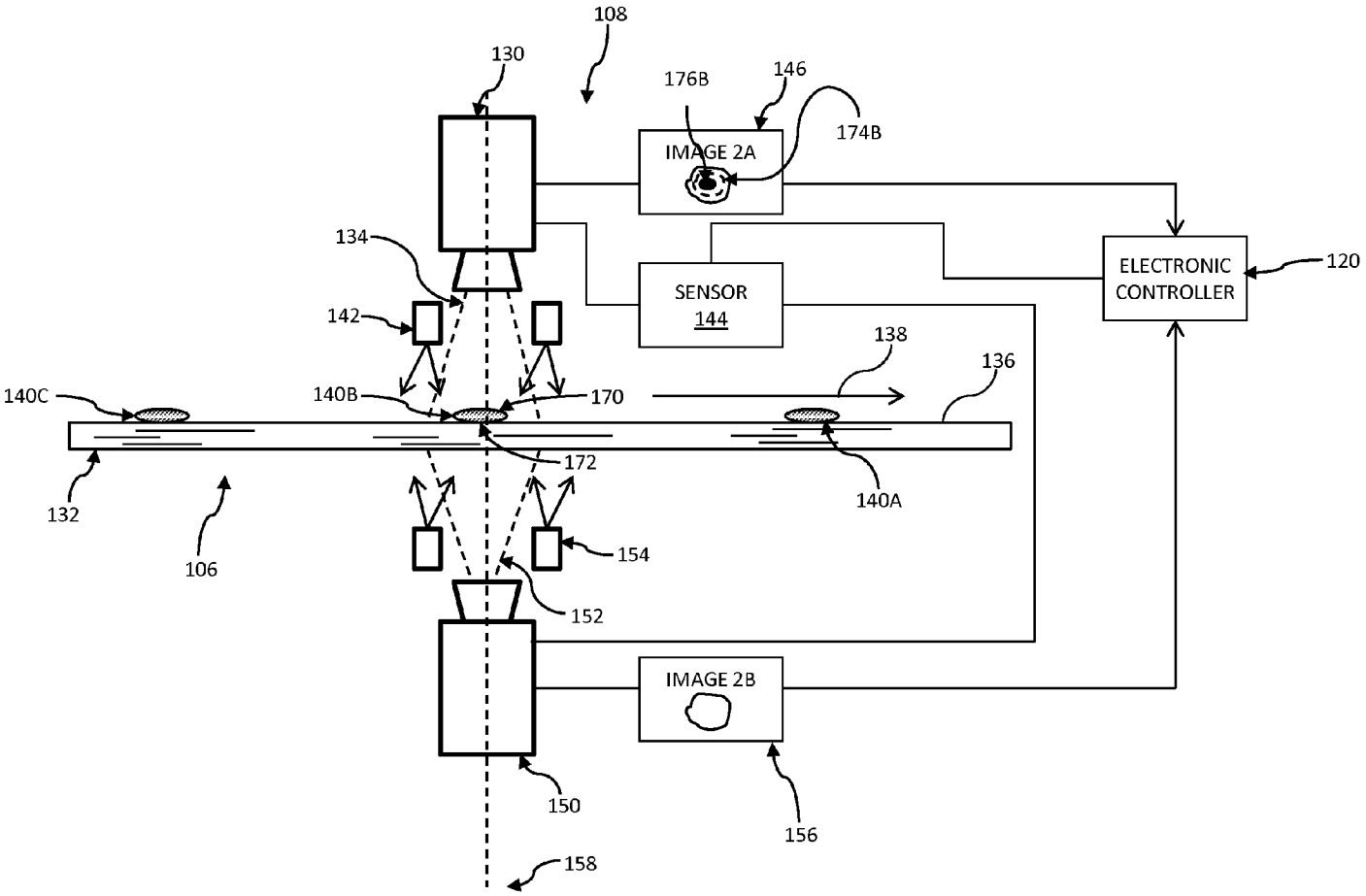
FIG. 3 illustrates an exemplary arrangement of cameras above and below a transport member to image a second seed.

Referring to FIGS. 2 and 3, an exemplary imaging system 108 is illustrated. Imaging system 108 includes a first camera 130 positioned above a transport member 132 of transport system 106. In one embodiment, first camera 130 is a Model No. DFW-X710 available from Sony Electronics Inc. located at 1 Sony Drive in Park Ridge, N.J. 07656. First camera 130 has a field of view 134 which is focused on the location of the seed on the transport member 132. A first seed 140A is shown supported by an upper surface 136 of transport member 132. Transport member 132 moves generally in direction 138 to advance first seed 140A into field of view 134 and out of field of view 134. A second seed 140B is shown further back on upper surface 136 of transport member 132.

A light 142 illuminates first seed 140A while first seed 140A is in field of view 134 of first camera 130. In one embodiment, light 142 is a High Frequency Vision Illuminator, Model 10 available from StockerYale, Inc. located at 32 Hampshire Road in Salem, N.H. 03079. A sensor 144 detects when first seed 140A is in field of view 134. In one embodiment, sensor 144 is an optical sensor. An exemplary optical sensor is a retro reflection sensor, such as Model No. QS18VN6LPQ5 available from Banner Engineering located at 9714 Tenth Avenue North in Minneapolis, Minn. 55441. In one embodiment, sensor 144 is directly connected to first camera 130 to provide an input to first camera 130 on when to capture an image 146 of first seed 140A. In one embodiment, sensor 144 is coupled to electronic controller 120 which in turn provides an input to first camera 130 on when to capture an image 146 of first seed 140A. Although a single image is shown, first camera 130 may capture multiple images of first seed 140A while first seed 140A is within field of view 134.

In one embodiment, as illustrated in FIG. 2, imaging system 108 includes a second camera 150 positioned below transport member 132 of transport system 106. In one embodiment, second camera 150 is a Model No. DFW-X710 available from Sony Electronics Inc. located at 1 Sony Drive in Park Ridge, N.J. 07656. Second camera 150 has a field of view 152 which is focused on the location of the seed on the transport member 132. A light 154 illuminates first seed 140A while first seed 140A is in field of view 152. In one embodiment, light 154 is a High Frequency Vision Illuminator, Model 10 available from StockerYale, Inc. located at 32 Hampshire Road in Salem, N.H. 03079.

In one embodiment, sensor 144 is directly connected to second camera 150 to provide an input to second camera 150 on when to capture an image 156 of first seed 140A. In one embodiment, sensor 144 is coupled to electronic controller 120 which in turn provides an input to second camera 150 on when to capture an image 156 of first seed 140A. Although a single image is shown, second camera 150 may capture multiple images of first seed 140A while first seed 140A is within field of view 152.

As arranged in FIG. 2, the optical axis of first camera 130 and second camera 150 are aligned along line 158. In one embodiment, first camera 130 and second camera 150 capture image 146 and 156, respectively, at generally the same time. In one embodiment, first camera 130 is moved to location 160 such that the optical axis of first camera 130 is along with line 162 and the optical axis of second camera 150 is along line 158. In this arrangement, sensor 144 monitors field of view 134 to see when first seed 140A crosses line 162. Electronic controller 120 is programmed to know the separation between line 162 and line 158 and the speed of travel of transport member 132 in direction 138. As such, electronic controller 120 may determine when first seed 140A will cross line 158 based on when the seed crosses line 162. In this arrangement, image 146 is captured prior to image 156. In one embodiment, sensor 144 includes two separate sensors, one which monitors when first seed 140A crosses line 162 and one which monitors when first seed 140A crosses line 158. In one embodiment, second camera 150 is centered on line 162 and first camera 130 is centered on line 158. In this case, sensor 144 monitors field view 152 to see when first seed 140A crosses line 162.

Figure 4:
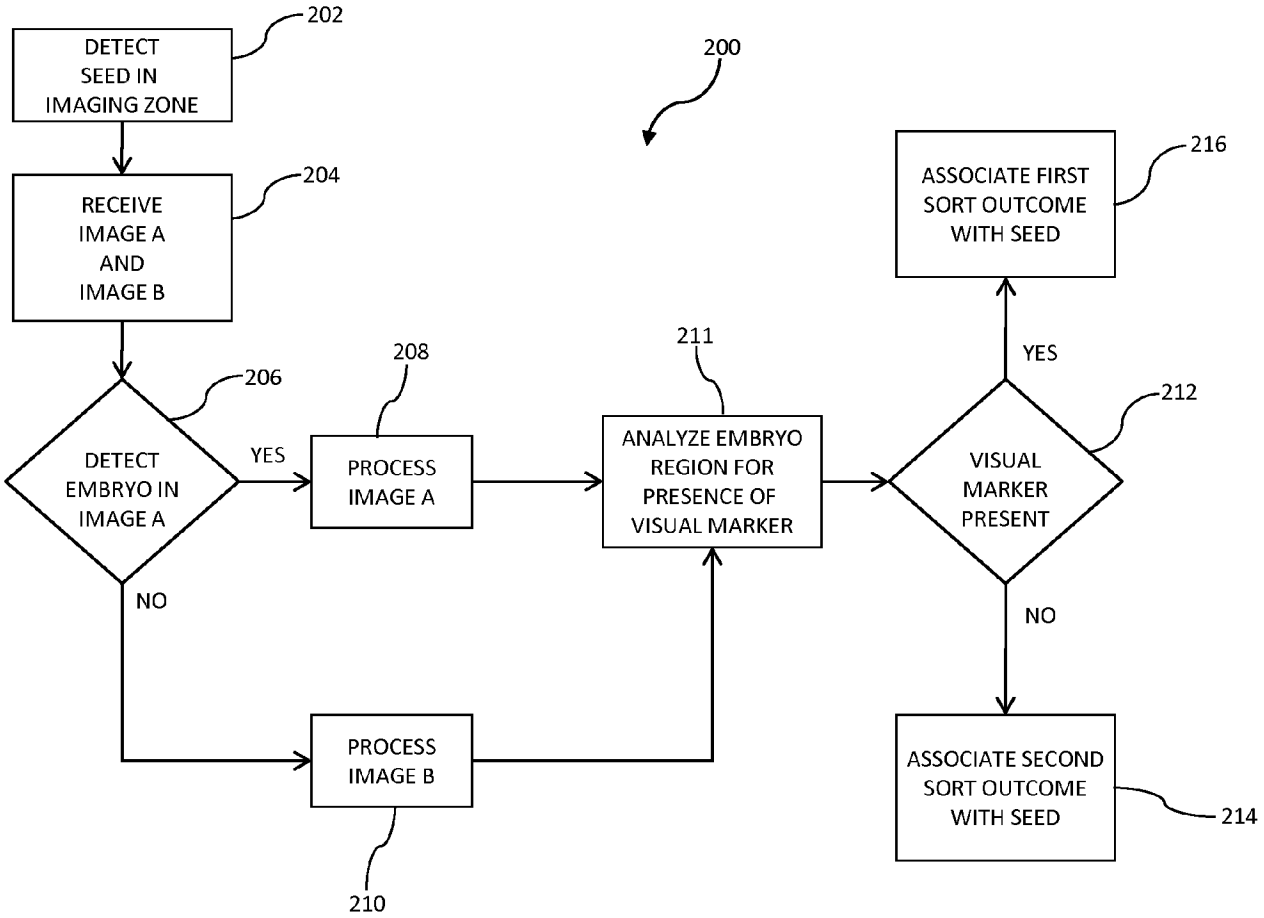
FIG. 4 illustrates an exemplary sorting method.

Referring to FIG. 4, an exemplary sorting process 200 of electronic controller 120 is illustrated. Electronic controller 120 receives an input from sensor 144 that first seed 140A is located in field of view 134 and field view 152 (in the case of first camera 130 and second camera 150 being in line), as represented by block 202. Electronic controller 120 receives image 146 of first seed 140A from first camera 130 and image 156 of first seed 140A from second camera 150, as represented by block 204. In one embodiment, electronic controller 120 instructs first camera 130 and second camera 150 when to capture image 146 and image 156 based on the input from sensor 144. In one embodiment, first camera 130 and second camera 150 each determine when to capture image 146 and image 156 based on the input from sensor 144. Although a single image 146 and a single image 156 are shown, in one embodiment, multiple images are captured by both first camera 130 and second camera 150 for analysis.

Electronic controller 120 then analyzes image 146 and image 156 to determine at least one characteristic of first seed 140A and based on that at least one characteristic make a sorting decision. In the case of double haploid breeding of corn seed, a visible genetic color marker in an embryo region of the corn seed is utilized to identify diploid seeds as well as putative haploid seeds. The male pollinator, or haploid inducer, confers a dark purple color exhibited in the fertilized seed endosperm by passing on the Navajo marker gene rnj. The presence of the genetic marker color in the embryo tissue of the corn seed indicates that the seed has two sets of chromosomes, one from the female parent and one from the male parent (diploid seeds). The absence of the genetic marker color in the embryo tissue indicates that no male genes entered the ovule nucleus, leaving the embryo with only one set of chromosomes inherited from the female parent (putative haploid seeds).

For purposes of illustration, seeds 140 are corn seeds produced as the result of double haploid breeding. Electronic controller 120 examines the embryo region of seeds 140 to determine whether the seeds 140 include one set of chromosomes or two sets of chromosomes. The seeds 140 are sorted based thereon.

Returning to FIG. 4, electronic controller 120 examines image 146 to see if it includes the embryo region, as represented by block 206. Only one side of first seed 140A includes the embryo region. Seed lot 104 is comprised of generally flat kernels. Image 146 is an image of a first side 170 of first seed 140A and image 156 is an image of a second side 172 of first seed 140A. For seed 140A in FIG. 2, image 156 includes embryo region 174A. For seed 140B in FIG. 3, image 146 includes embryo region 174B.

As mentioned, for seed 140A image 146 does not include embryo region 174. If image 146 included embryo region 174 then electronic controller 120 would process image 146, as represented by block 208. In one embodiment, electronic controller 120 would simply discard image 156 of seed 140A. Since image 156 includes embryo region 174 electronic controller 120 processes image 156, as represented by block 210. In one embodiment, electronic controller 120 simply discards image 146 of seed 140A.

Whichever image is selected for processing is analyzed to determine if embryo region 174 includes a visual marker of the Navajo marker gene rnj, as represented by block 211. The exemplary visual marker is the presence of a purplish color in the embryo region 174. Other exemplary visual markers may be present for other sorting situations. For example, seedlings may be separated based on whether the root color is red or not.

Referring to FIG. 2, first seed 140A does not include the visual marker in embryo region 174. As such, electronic controller 120 associates a second sorting outcome with first seed 140A, as represented by blocks 212 and 214. An exemplary second sorting outcome is to accept first seed 140A. Referring to FIG. 3, second seed 140B includes a visual marker 176B of the Navajo marker gene rnj. As such, electronic controller 120 associates a first sorting outcome with second seed 140B, as represented by blocks 212 and 216. An exemplary first sorting outcome is to reject second seed 140B. The first and second sorting outcomes are used to control sorting system 110. As mentioned in connection with FIG. 1, in one embodiment, second seed 140B would be directed towards reject container 112 and first seed 140A would be directed towards accept container 114.

Figure 5:
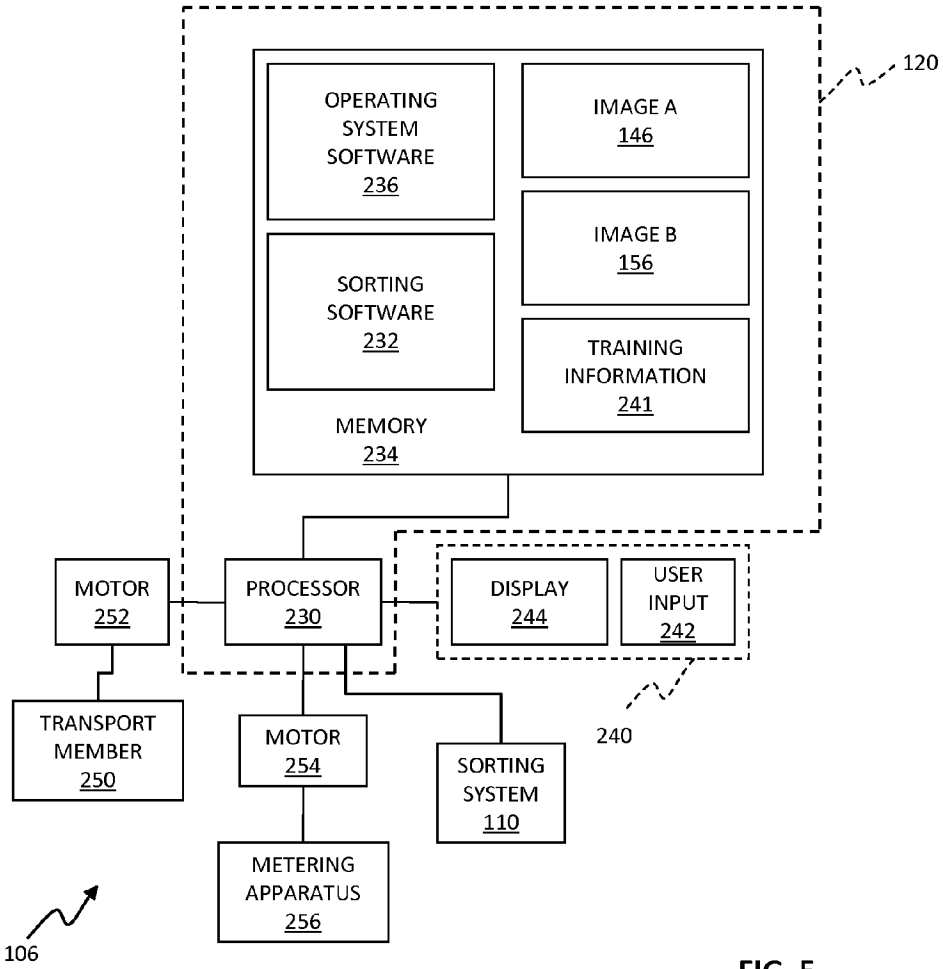
FIG. 5 illustrates an exemplary electronic controller.

Referring to FIG. 5, in one embodiment, electronic controller 120 includes a processor 230 which executes sorting software 232 which is stored in a memory 234. The sorting software 232 executes sorting process 200. In one embodiment, electronic controller 120 is a computer having an operating system 236. In one embodiment, electronic controller 120 is a computer executing a WINDOWS based operating system.

The sorting software 232, in one embodiment, is the PC_EYEBOT software available from Sightech Vision Systems located at 2953 Bunker Hill Ln, Suite 400 in Santa Clara, Calif. The PC_EYEBOT software uses neural network processing to learn how to distinguish between objects.

When the PC_EYEBOT software is used for sorting software 232, initially the software must be presented with seeds 140 from each category and be instructed regarding the appropriate category so that it can learn to distinguish future seeds 140. The training information is represented by block 241. Input and feedback may be provided through user interface 240. User interface 240 includes user input devices 242 through which an operator may provide input to sorting software 232 during training or at other times. Exemplary user input devices 242 include a mouse, a keyboard, a trackball, a touch interface, or other suitable input devices. User interface 240 also includes a display 244 by which sorting software 232 may present either image 146 or image 156. Sorting software 232 may provide an indication of the region of image 146 or image 156 that sorting software 232 has identified as embryo region 174 and, if detected, an indication of the region of image 146 or image 156 that sorting software 232 has identified as visual marker 176. The operator may then confirm a correct classification of seeds 140 through user input devices 242 or provide input through user input devices 242 to assist in training sorting software 232 regarding its incorrect classification of seeds 140. Due to color variations in different seed lots 104, in one embodiment, sorting software 232 is trained for each seed lot individually. Color marker expression can vary slightly among kernels within a population, and vary significantly between populations. Once appropriately trained, sorting software 232 may make sorting decisions for seeds 140 of seed lot 104. Populations with very similar seed phenotype and marker expression can be sorted with the same training file.

As shown in FIG. 5, electronic controller 120 is coupled to transport system 106 and sorting system 110. Transport system 106 is shown to include a first motor 252 which drives a transport member 250, such as transport member 132 of FIG. 2 and a second motor 254 which drives a metering device 256. Metering device 256 places seeds 140 on transport member 250 in a spaced apart arrangement with generally equal spacing between consecutive seeds 140. An exemplary metering device is a seed meter for a planter available from Precision Planting located at 23207 Townline Road in Tremont, Ill. 61568. Additional details regarding an exemplary metering device are provided in U.S. Pat. No. 6,729,249, the disclosure of which is expressly incorporated by reference herein. Another exemplary device for placing seed on transport member 250 would be a vibration type of feeder. An exemplary type of vibration feeder is provided as part of a Model U seed counter available from International Marketing and Design Corporation located at 13802 Lookout Road Suit 200 in San Antonio, Tex. 78233.

Figure 6:
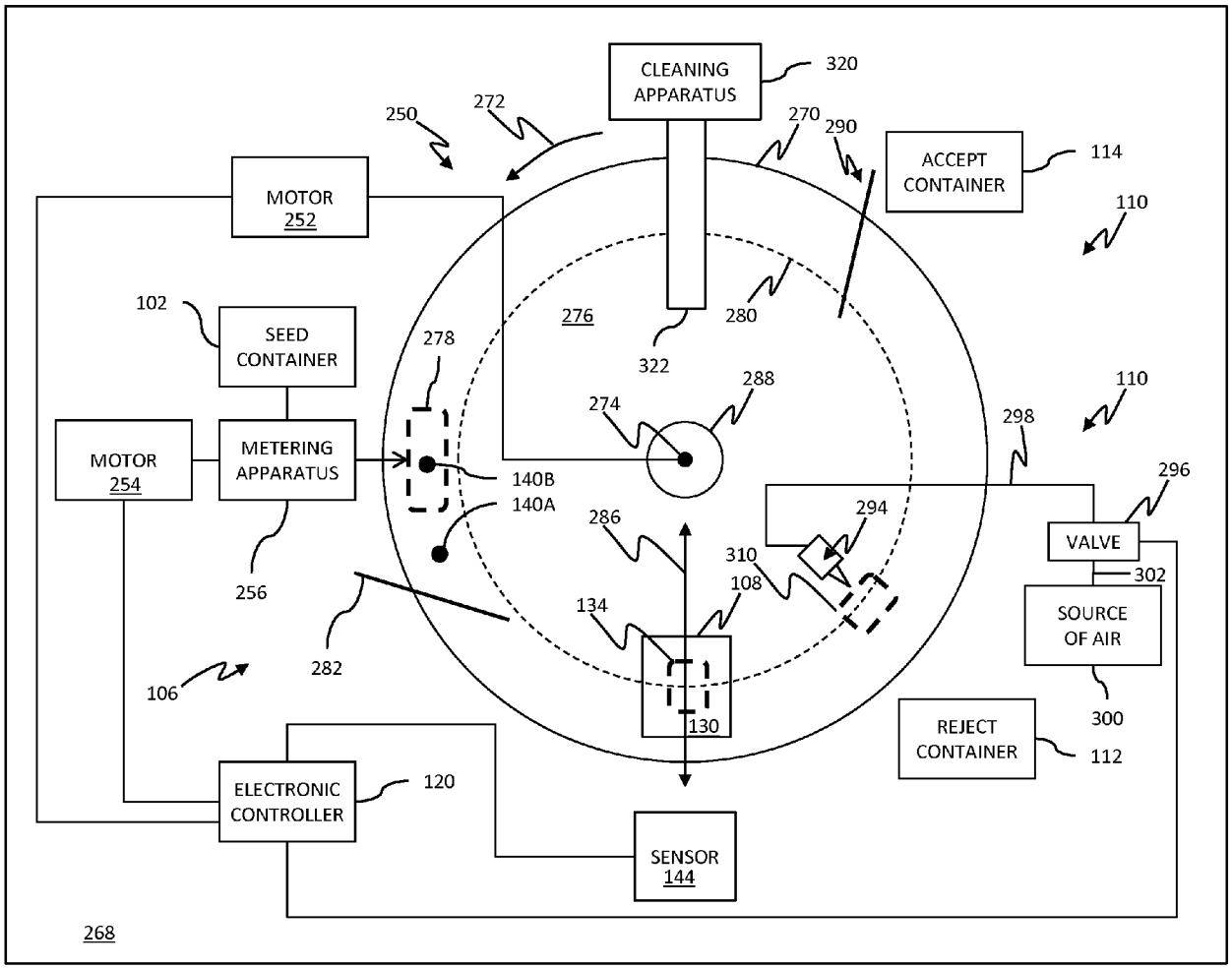
FIGS. 6-11 illustrate the operation of an exemplary sorting apparatus.

Referring to FIGS. 6-13, an exemplary seed sorting apparatus 100 is shown. Referring to FIG. 6, seed sorting apparatus 100 includes an exemplary transport system 106, an exemplary imaging system 108, an exemplary sorting system 110, and an exemplary electronic controller 120 each supported by a frame 268. Transport system 106 includes a transport member 250, illustratively a rotating disc 270 which rotates in a direction 272. Rotating disc 270 is supported on a shaft 274 which is driven by first motor 252.

Metering device 256 places seeds 140 received from seed container 102 on a top surface 276 of rotating disc 270. In the illustrated embodiment, seeds 140 are placed on top surface 276 one at a time in spaced apart arrangement. Seeds 140 are placed on top surface 276 at a first location 278. Illustratively, first seed 140A and second seed 140B are shown on top surface 276 of rotating disc 270. First seed 140A is placed on top surface 276 first in first location 278. Rotating disc 270 rotates further in direction 272 and then second seed 140B is placed on top surface 276.

As shown in FIG. 6, the field of view 134 of first camera 130 is centered at a given radial distance of rotating disc 270 marked as circle 280. Although not shown, the field of view 152 of second camera 150 overlaps field of view 134 of first camera 130 from the bottom side of rotating disc 270. Rotating disc 270, in one embodiment, is made of glass or another transparent material so that second camera 150 is able to image seeds 140 through rotating disc 270. In one embodiment, only the portion of rotating disc 270 generally around circle 280 is made of a transparent material. In one embodiment, the portion of rotating disc 270 including circle 280 is depressed to assist in retaining seeds 140 as rotating disc 270 rotates at a higher rate.

Figure 7:
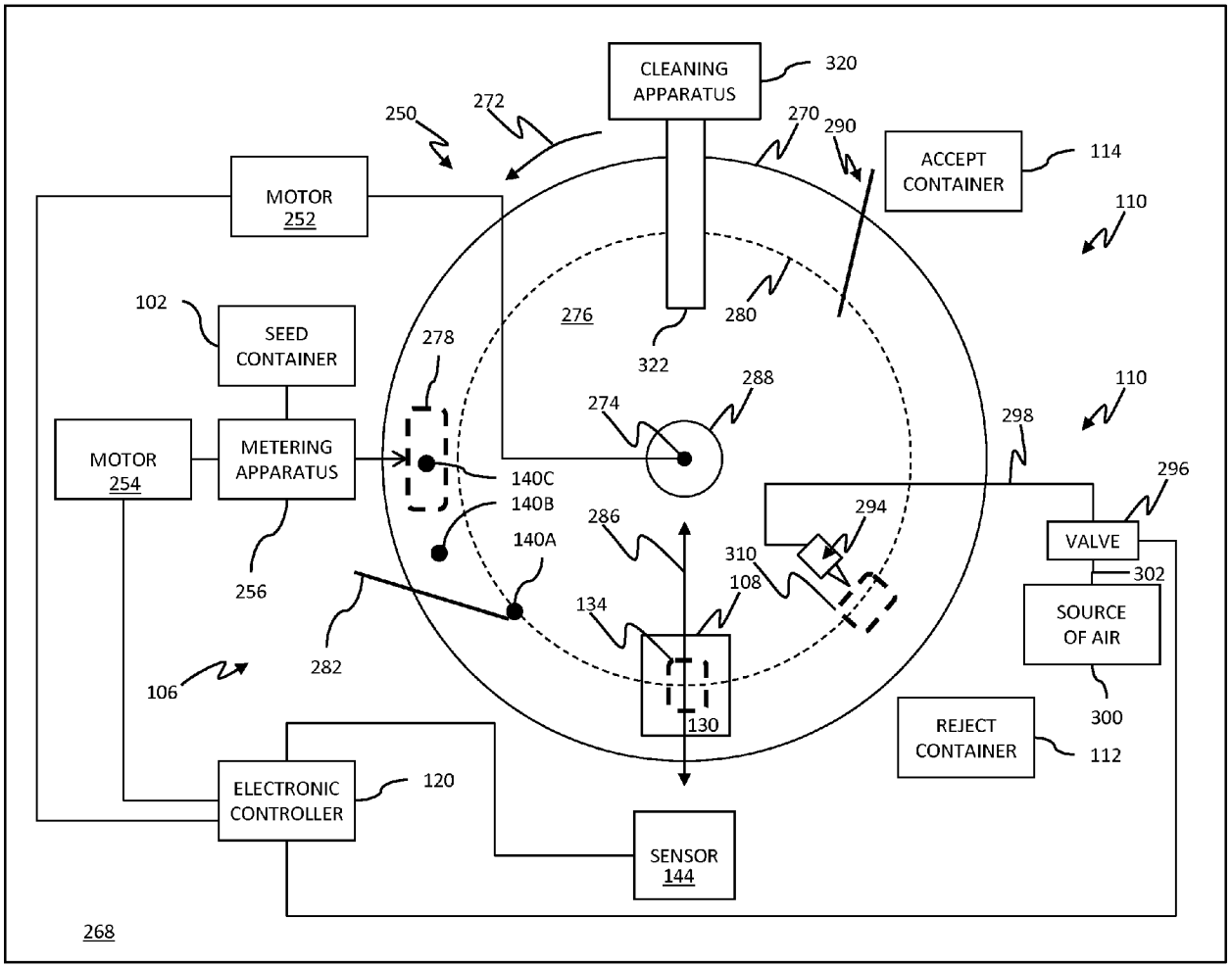

In one embodiment, metering device 256 places seeds 140 generally on circle 280. In the illustrated embodiment, metering device 256 places seeds 140 radially further out on rotating disc 270 than circle 280. A guide 282 then moves seeds 140 such that they are generally positioned on circle 280. In one embodiment, guide 282 is a wiper that has a flexible blade which rests on or is slightly spaced apart from top surface 276 of rotating disc 270. As shown in FIG. 7, the angle of guide 282 generally directs seeds 140 towards circle 280.

Figure 8:
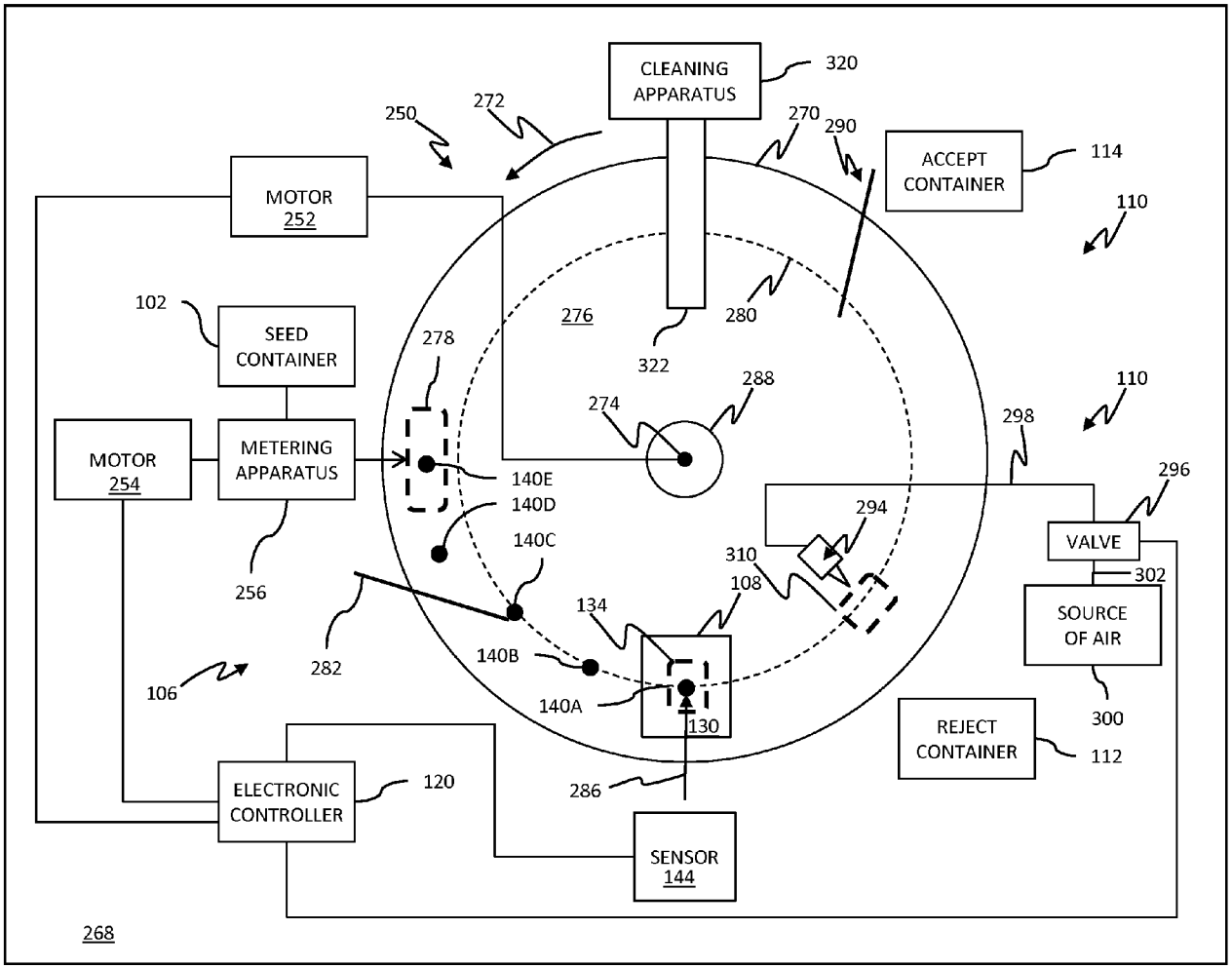

Referring to FIG. 8, first seed 140A is positioned in field of view 134 due to the further rotation of rotating disc 270 in direction 272. As explained herein, electronic controller 120 makes a sorting decision regarding first seed 140A. Sensor 144 detects the presence of first seed 140A in the position shown in FIG. 8. Referring to FIG. 6, an exemplary sensor is a retro reflection sensor which sends out a beam of optical energy which in the absence of seeds 140 in field of view 134 is retro-reflected off of a retro-reflecting member 288 supported by rotating disc 270. An exemplary retro reflection sensor is Model No. QS18VN6LPQ5 available from Banner Engineering located at 9714 Tenth Avenue North in Minneapolis, Minn. 55441. As shown in FIG. 8, the presence of first seed 140A in field of view 134 blocks the retro-reflection of optical energy 286. This break in the retro-return is interpreted by sensor 144 as the presence of seeds 140 in field of view 134.

As mentioned in connection with FIG. 2, first seed 140A does not include visual marker 176 in embryo region 174. As such, electronic controller 120 associates the second sorting outcome with first seed 140A. This is interpreted by sorting system 110 to direct first seed 140A towards accept container 114 as opposed to towards reject container 112. An exemplary sorting system 110 is shown in FIG. 6.

Sorting system 110 includes a guide 290 which removes seeds 140 from rotating disc 270 and directs it towards accept container 114. In one embodiment, guide 290 is a wiper that has a flexible blade which rests on or is slightly spaced apart from top surface 276 of rotating disc 270. The angle of guide 290 generally directs seeds 140 towards accept container 114. In one embodiment, rotating disc 270 includes slots through which seeds 140 fall as they travel towards accept container 114. In the illustrated embodiment, seeds 140 are directed off of the edge of rotating disc 270. Sorting system 110 removes seeds 140 which are associated with the first sorting outcome prior to the seeds 140 reaching guide 290. In one embodiment, sorting system 110 removes seeds 140 having the second sorting outcome from rotating disc 270 prior to the seeds 140 having the first sorting outcome.

A first exemplary device 292 is shown in FIG. 6 to remove seeds 140 from rotating disc 270 that are associated with the first sorting outcome. First exemplary device 292 includes an air nozzle 294 which is supported above rotating disc 270. Air nozzle 294 is in fluid communication with a valve 296 through a fluid conduit 298. Valve 296 is also in fluid communication with a source of pressurized air 300 through a fluid conduit 302. In operation, electronic controller 120 causes valve 296 to open when a given seed 140 having the first sorting outcome is positioned generally in line with air nozzle 294. Otherwise valve 296 is closed.

Figure 12:
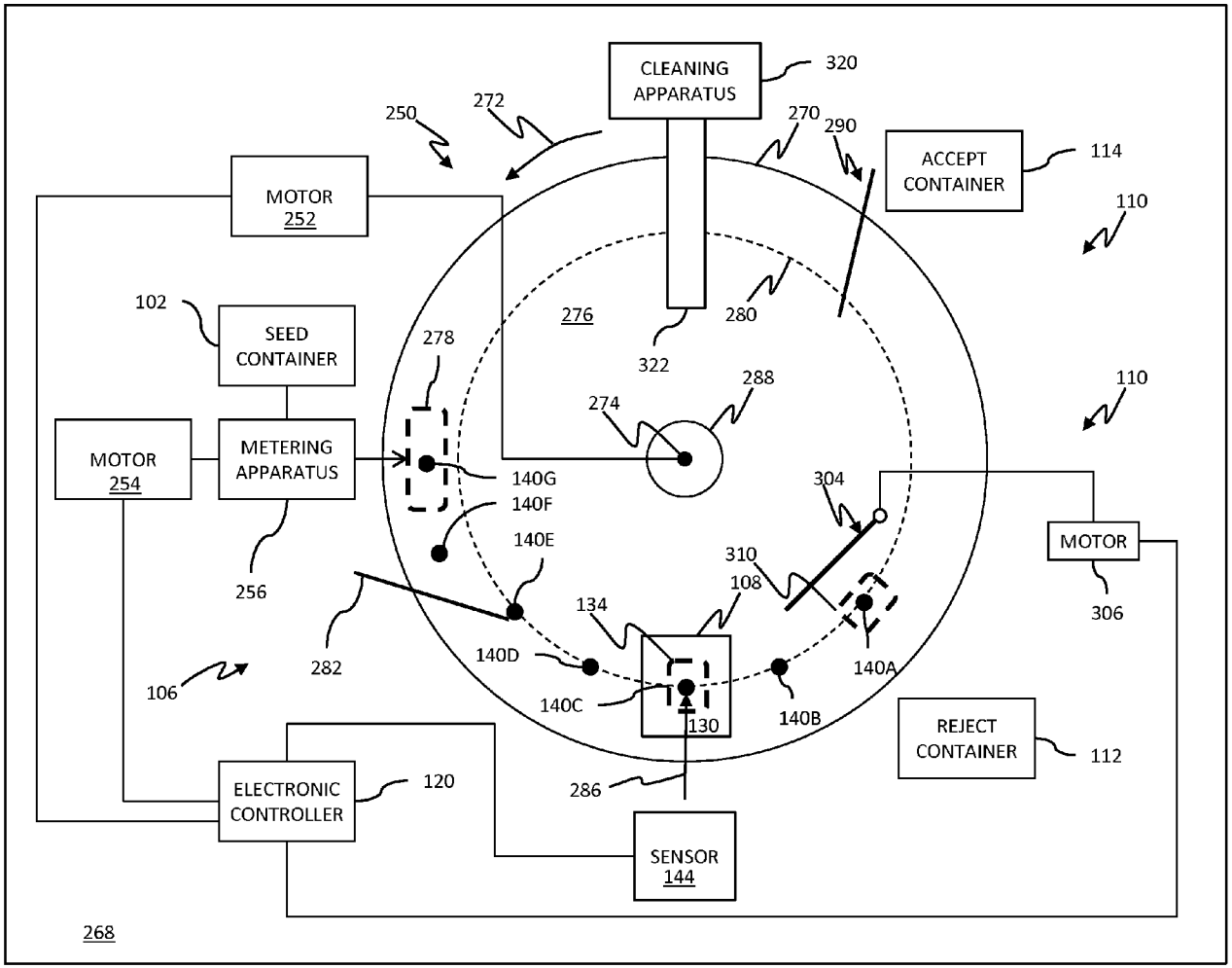
FIGS. 12 and 13 illustrate the operation of another exemplary sorting apparatus.
Figure 13:
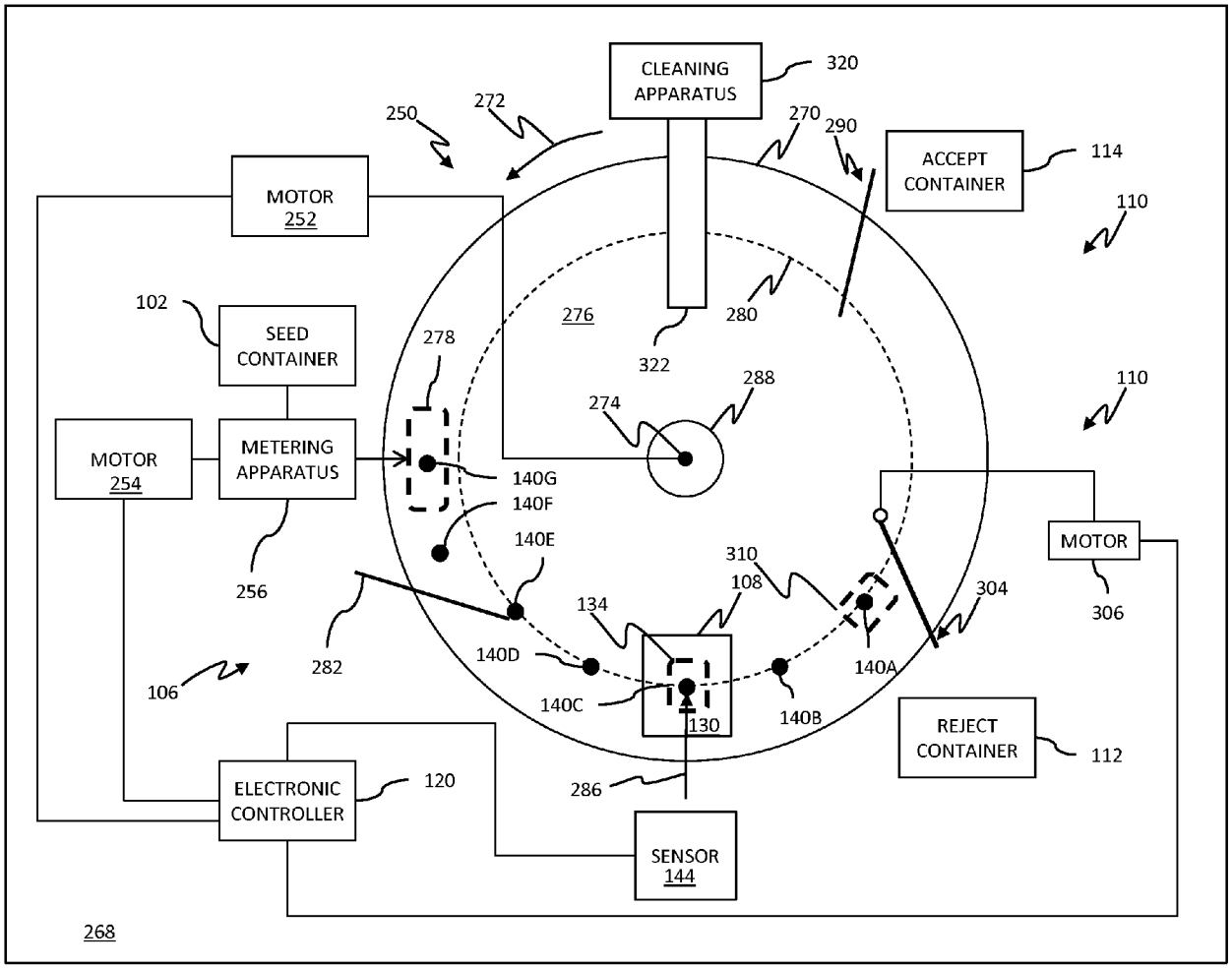

A second exemplary device 304 is shown in FIGS. 12 and 13 for removing seeds 140 from rotating disc 270 that are associated with the first sorting outcome. Second exemplary device 304 includes a guide 306 which is rotated by a motor 308 between a first position shown in FIG. 12 (for seeds 140 being associated with the second sorting outcome) and a second position shown in FIG. 13 (for seeds 140 being associated with the first sorting outcome). In one embodiment, guide 290 is a wiper that has a flexible blade which rests on or is slightly spaced apart from top surface 276 of rotating disc 270. Motor 308 is controlled by electronic controller 120.

Returning to FIG. 8, first seed 140A is within field of view 134 and field view 152. As mentioned in connection with FIG. 2, first seed 140A does not include visual marker 176 in embryo region 174. As such, electronic controller 120 associates the second sorting outcome with first seed 140A. Rotating disc 270 continues to rotate in direction 272. Second seed 140B is placed within field of view 134 and field view 152. As mentioned in connection with FIG. 3, second seed 140B includes visual marker 176 in embryo region 174. As such, electronic controller 120 associates the first sorting outcome with second seed 140B.

Figure 9:
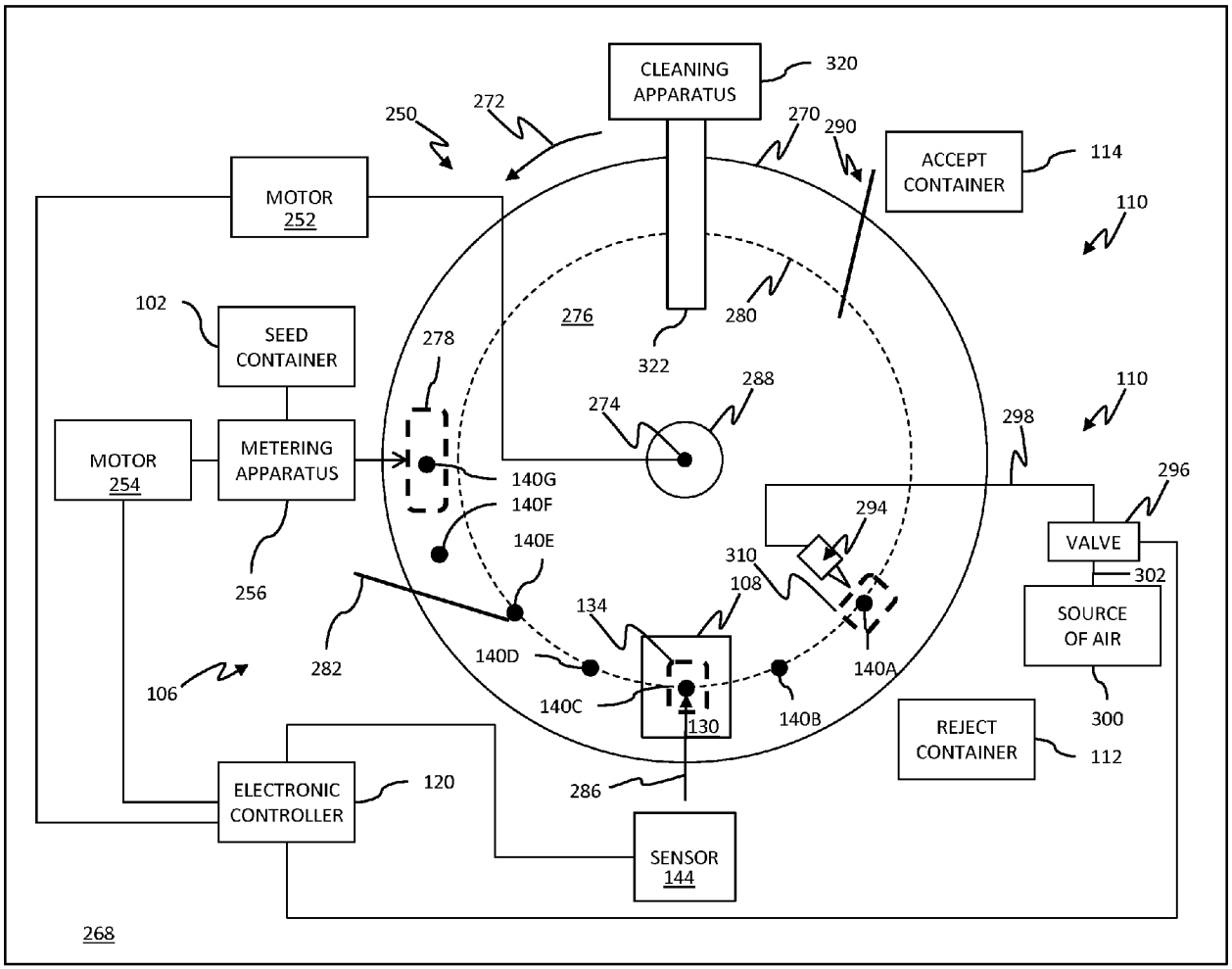
Figure 10:
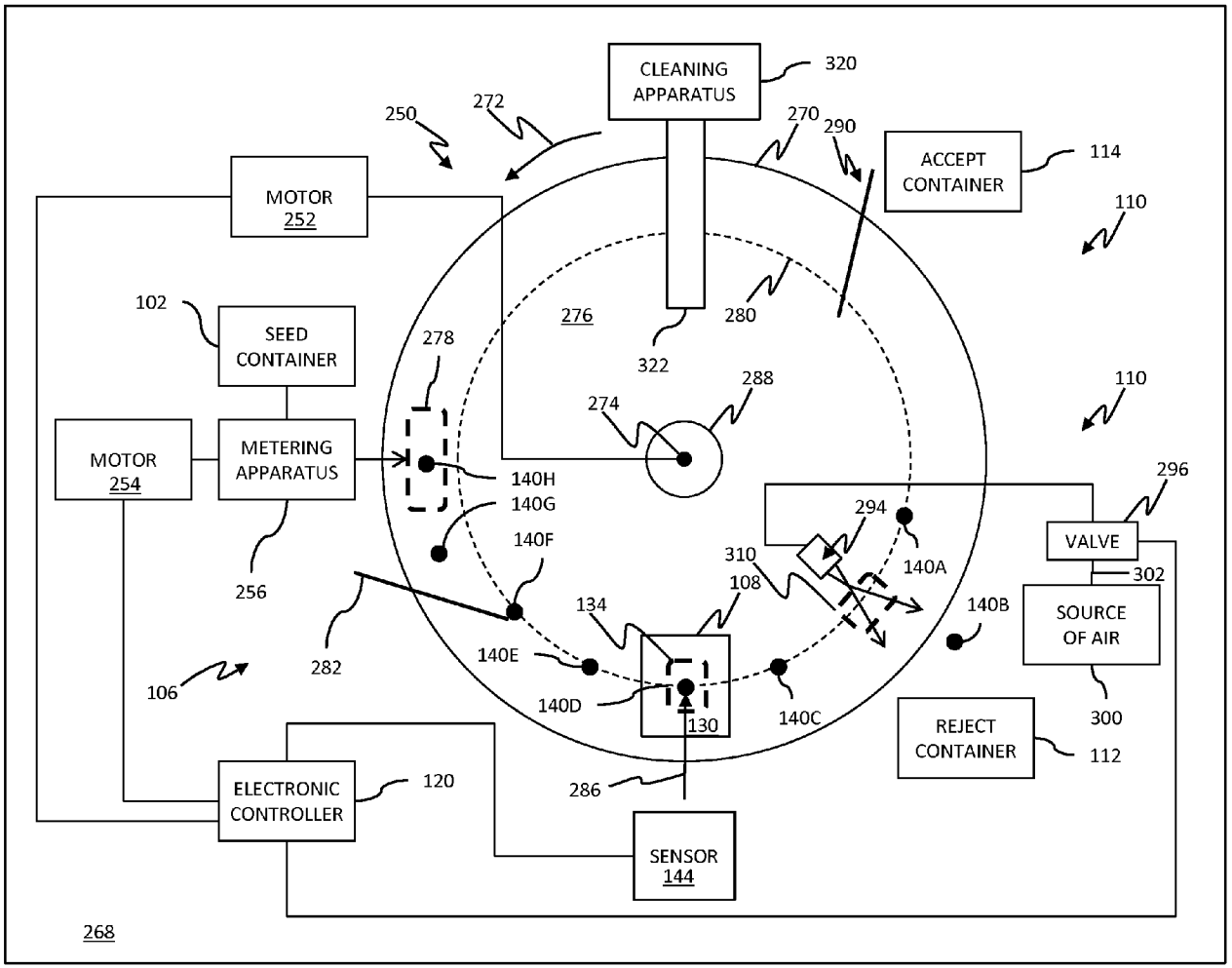
Figure 11:
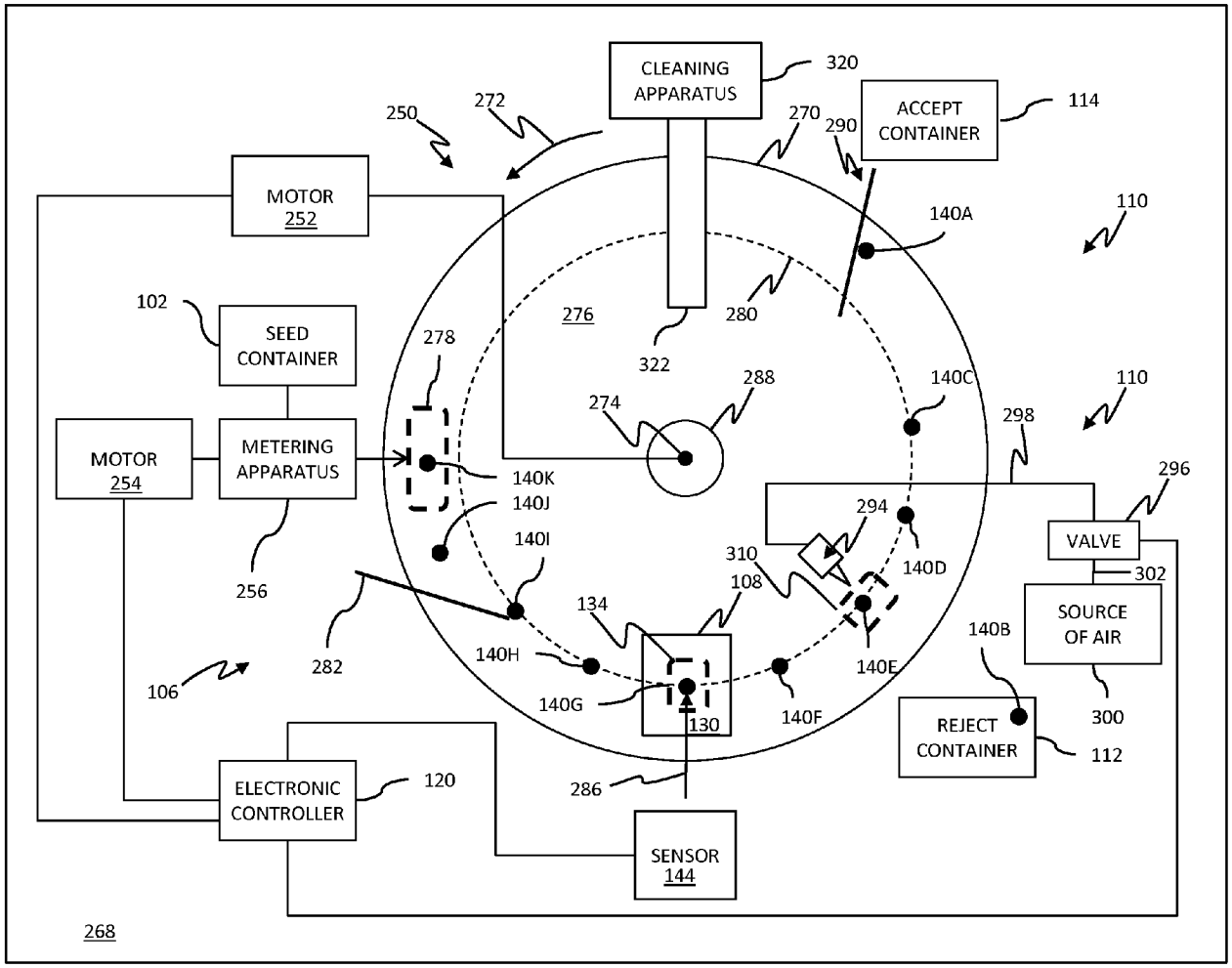

Referring to FIG. 9, rotating disc 270 continues to rotate in direction 272. First seed 140A is now in location 310 in front of air nozzle 294. Valve 296 remains closed because first seed 140A has the second sorting outcome associated therewith. Referring to FIG. 10, when second seed 140B is in location 310, valve 296 is opened and second seed 140B is blown off rotating disc 270 towards reject container 112. It should be noted that electronic controller 120 knows when second seed 140B is going to be in location 310 due to its knowledge of the location of second seed 140B on rotating disc 270 and the speed of rotation of rotating disc 270. In one embodiment, a separate sensor is used, like sensor 144, to determine when second seed 140B is in location 310. Referring to FIG. 11, first seed 140A (second sorting outcome), seed 140C (second sorting outcome), and seed 140D (second sorting outcome) have passed location 310 and are on the way towards accept container 114.

Seed sorting apparatus 100 also includes a cleaning apparatus 320 which cleans top surface 276 of rotating disc 270 so that dust and other particulate buildup does not interfere with the imaging of first camera 130 or second camera 150. In one embodiment, cleaning apparatus 320 is a cloth 322 which is in contact with top surface 276.

Figure 16:
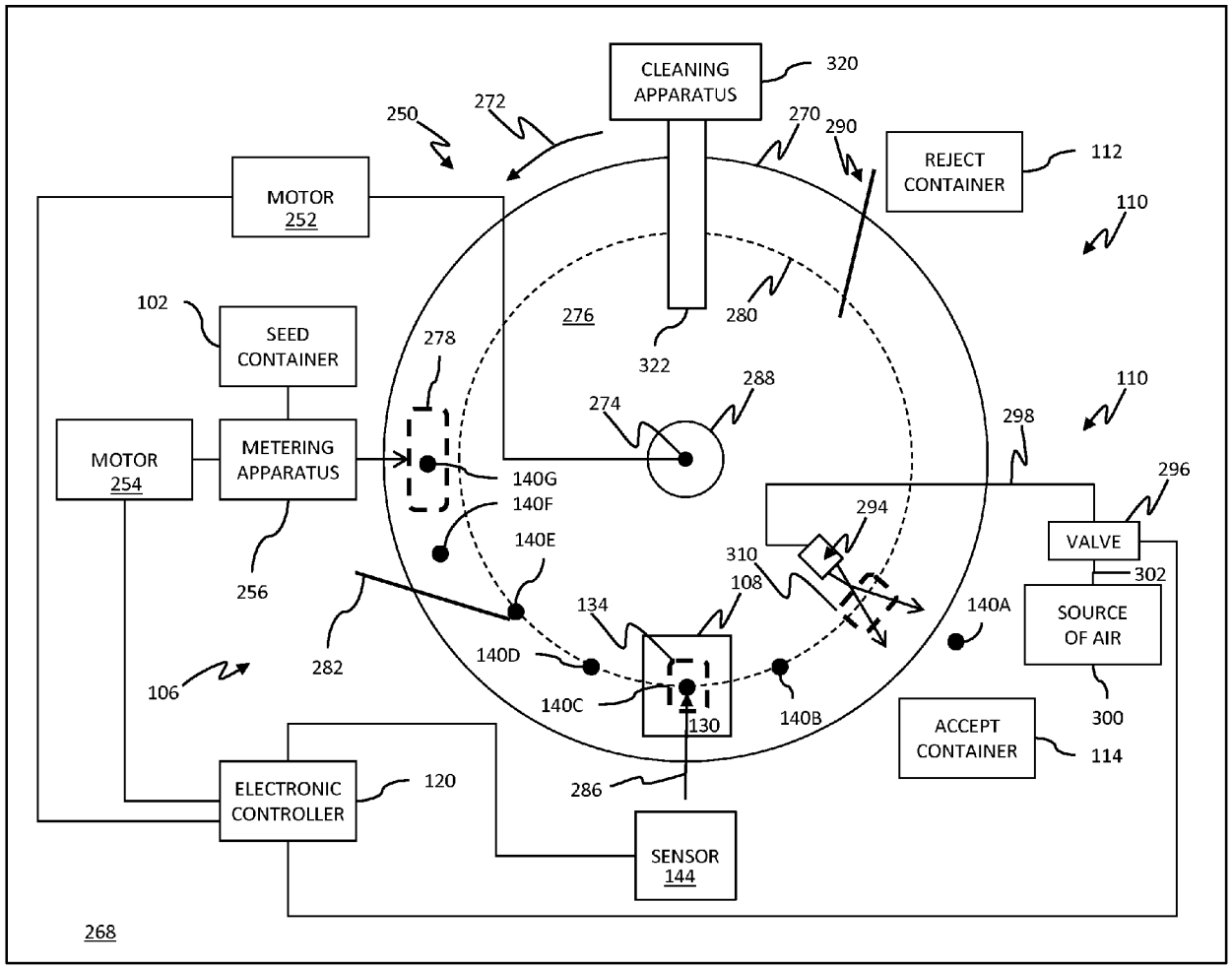
FIG. 16 illustrates another arrangement of the sorting apparatus of FIGS. 6-11.

In one embodiment, location 310 corresponds to seeds 140 which are acceptable, not rejected. In this scenario, sorting system 110 would only activate air nozzle 294 when the given seed 140 has an associated second sorting outcome. this is illustrated in FIG. 16. Seed 140A is being directed towards accept container 112 by the air exiting air nozzle 294. The arrangement of FIG. 16 is preferable in situations wherein a majority of the seeds 140 will be rejects and destined for reject container 114. As such, air nozzle 294 does not need to be activated as often.

Figure 15:
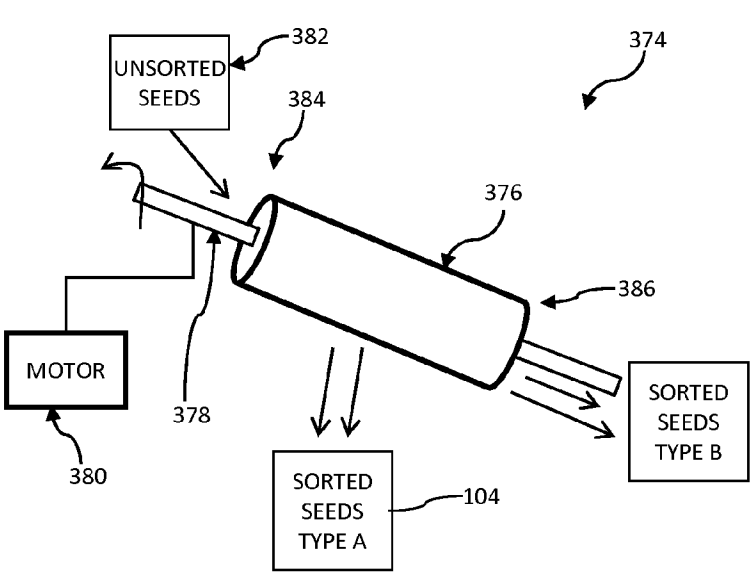
FIG. 15 illustrates an exemplary apparatus for sorting seeds based on an exterior shape of the seed.
Figure 14:
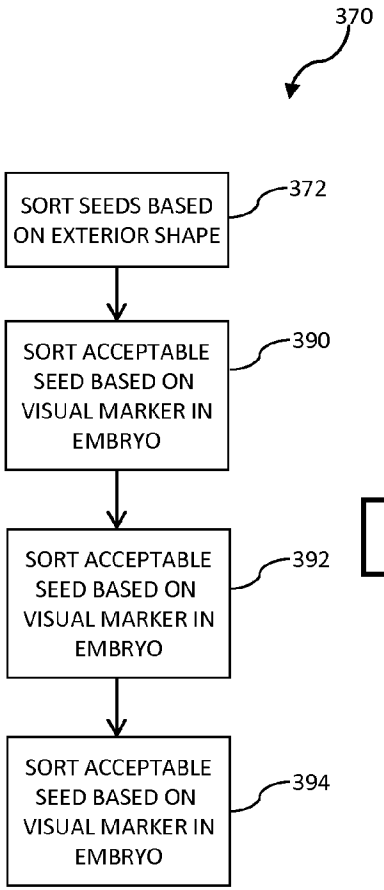
FIG. 14 illustrates another exemplary sorting method.

Referring to FIG. 14, an exemplary method 370 of sorting seed 140 of a seed lot 104 is shown. The seed lot 104 is cleaned of all plant debris. The seed lot 104 is sorted based on an external shape of the seed 140, as represented by block 372. In one embodiment, seed lot 104 is processed through screens to select flat kernels for mechanical sorting with seed sorting apparatus 100. Round or irregular shaped kernels cannot be presented consistently in a position that displays the embryo to the cameras 130 and 150. Referring to FIG. 15, an exemplary screen apparatus 374 is shown. A screen 376 is arranged in a cylindrical manner and is supported by a shaft 378 which is driven by a motor 380. Unsorted, cleaned seed lot 382 is presented through an upper end 384 of screen 376. The flat kernels pass through the screen 376 and are collected as seed lot 104. In one embodiment, the openings in screen 376 are rectangular and are about 12/64 of an inch by about ¾ of an inch in size. The remaining round or irregular shaped kernels do not pass through the screen and are collected once they exit a lower end 386 of screen 376.

Seed lot 104 is then sorted by seed sorting apparatus 100, as represented by block 390. In one embodiment, this is the end of method 370. In one embodiment, method 370 continues and the seed 140 collected in accept container 114 is feed through either the same seed sorting apparatus 100 again or a separate seed sorting apparatus 100, as represented by blocks 392 and 394. In this manner, in the first pass represented by block 390 seed sorting apparatus 100 may be run at a higher rate and effectively discard a first percentage of seed 140 having clear visual markers. The second and subsequent passes may then be run at slower rates providing sorting software 232 with the ability to make finer distinctions of seeds 140.

Example 1

Due to color marker spectrum variability within a population, 100% coverage of possible spectrum is unlikely in the training sub sample used to train sorting software 232. Undetected spectra leads to false "pass" decisions. Color spectrum "learned" in marker training can also be present in the lower reverse side of induced PHK, leading to false rejection of induced PHK. Recognition errors are also caused by improper presentation of PHK due to irregular shape of the kernels.

The seven populations presented in Table I were sorted with a sorting apparatus as described in connection with FIG. 6. As can be seen from the table, the sorting apparatus was effective in not selecting PHK for placement in the reject container 112. Only about 5% of the kernels in reject container 112 were incorrectly placed in reject container 112. A manual inspection of the kernels in the accept container 114 revealed that about 47% of the kernels on average were incorrectly placed in accept container 114. This is a significant improvement over the typically 90% reject seed encountered in an unsorted population.

TABLE I

Mechanical Sorting Efficiency

| Population | Diploids in reject container (%) | PHK in accept container (%) | Visual marker clarity |
|---|---|---|---|
| A | 95.3 | 47.3 | good |
| B | 92.0 | 46.0 | good |
| C | 94.0 | 41.3 | fair |
| D | 98.0 | 52.7 | good |
| E | 96.0 | 51.3 | good |
| F | 98.0 | 49.3 | good |
| G | 92.7 | 38.7 | fair |
| mean | 95.1 | 46.7 | |

While this invention has been described as relative to exemplary designs, the present invention may be further modified within the spirit and scope of this disclosure. Further, this application is intended to cover such departures from the present disclosure as come within known or customary practice in the art to which this invention pertains.

The invention claimed is:

1. An apparatus for sorting seeds of a seed lot, the apparatus comprising:

a transport system which supports at least one seed at a time;

an imaging system which captures at least one image of the at least one seed;

an electronic controller which identifies a presence of an embryo region in the at least one image of the at least one seed and makes a sorting decision regarding the at least one seed based on the embryo region of the at least one image of the at least one seed, the sorting decision having at least two sorting outcomes; and a sorting system which alters a path of at least one of a first seed and a second seed, wherein the electronic controller associates a first sorting outcome with the first seed and the electronic controller associates a second sorting outcome with the second seed, wherein the first sorting outcome is associated by the electronic controller with the first seed due to a detection of a visual marker in an embryo tissue of the first seed, wherein the transport system includes an endless support which continuously moves while the at least one seed is supported by the transport system.

2. The apparatus of claim 1, wherein the second sorting outcome is associated by the electronic controller with the second seed due to an absence of a detection of a visual marker in an embryo tissue of the second seed.

3. The apparatus of claim 1, wherein the transport system exposes a first side of the at least one seed to a first camera of the imaging system and a second side of the at least one seed to a second camera of the imaging system, the first camera capturing at least a first image of the first side of the at least one seed and the second camera capturing at least a second image of the second side of the at least one seed.

4. The apparatus of claim 3, wherein the electronic controller reviews the first image of the first side of the at least one seed to determine if the first side of the at least one seed includes the embryo region of the at least one seed.

5. The apparatus of claim 4, wherein if the first side of the at least one seed includes the embryo region of the at least one seed then the electronic controller reviews the embryo region of the at least one seed to determine if the embryo region of the at least one seed includes a visual marker.

6. The apparatus of claim 5, wherein the electronic controller associates the first sorting outcome with the at least one seed if the embryo region of the at least one seed includes the visual marker and the electronic controller associates the second sorting outcome with the at least one seed if the embryo region of the at least one seed has an absence of the visual marker in the embryo region of the at least one seed.

7. The apparatus of claim 1, wherein the transport system includes a metering apparatus which places the seed on a transport member which supports the seed in a spaced apart relationship.

8. The apparatus of claim 7, wherein the electronic controller is operatively coupled to the metering apparatus and the transport member to control the operation of the metering apparatus and the transport member.

9. The apparatus of claim 7, wherein the transport system further includes a guide which positions the seed at a location on the transport member that is in line with a field of view of the imaging system.

10. An apparatus for sorting seeds of a seed lot, the apparatus comprising:

a transport system which supports at least one seed at a time, wherein the transport system includes a metering apparatus which places the at least one seed on a transport member which supports the at least one seed in a spaced apart relationship, an endless support which supports the at least one seed on a surface of the endless support and a guide which positions the at least one seed at a location on the transport member that is in line with a field of view of the imaging system;

a cleaning apparatus positioned to clean the surface of the endless support;

an imaging system which captures at least one image of the at least one seed;

an electronic controller which identifies a presence of an embryo region in the at least one image of the at least one seed and makes a sorting decision regarding the at least one seed based on the embryo region of the at least one image of the at least one seed, the sorting decision having at least two sorting outcomes; and a sorting system which alters a path of at least one of a first seed and a second seed, wherein the electronic controller associates a first sorting outcome with the first seed and the electronic controller associates a second sorting outcome with the second seed, wherein for the first seed, the metering apparatus places the first seed on the endless support, the guide member then positions the first seed on the endless support, then the imaging system captures at least two images of the first seed, and then the sorting system alters the path of the first seed based on the first sorting outcome.

11. An apparatus for sorting seeds of a seed lot, the apparatus comprising:

a transport system which supports at least one seed at a time, wherein the transport system includes a metering apparatus which places the at least one seed on a transport member which supports the at least one seed in a spaced apart relationship, a continuously moving endless support which supports the at least one seed and a guide which positions the at least one seed at a location on the transport member that is in line with a field of view of the imaging system;

an imaging system which captures at least one image of the at least one seed;

an electronic controller which identifies a presence of an embryo region in the at least one image of the at least one seed and makes a sorting decision regarding the at least one seed based on the embryo region of the at least one image of the at least one seed, the sorting decision having at least two sorting outcomes; and a sorting system which alters a path of at least one of a first seed and a second seed, wherein the electronic controller associates a first sorting outcome with the first seed and the electronic controller associates a second sorting outcome with the second seed, wherein the endless support is a rotary support.

12. A method for sorting seeds of a seed lot, the method comprising the steps of:

(a) supporting a plurality of seeds on a continuously moving transport member;

(b) capturing at least one image of an embryo region of a plurality of seeds;

(c) for each seed of the plurality of seeds identifying a presence of the embryo region and determining if an embryo tissue in the embryo region of the seed includes a visual marker; and (d) automatically sorting each seed of the plurality of seeds into one of at least two groups based on the determination made in step (c).

13. The method of claim 12, further comprising the step of collecting the seed sorted into a first group in a container.

14. The method of claim 12, further comprising the step of sorting the seed lot based on an exterior shape of the seed prior to step (b), the plurality of seeds being a portion of the seed lot.

15. The method of claim 14, wherein the plurality of seed includes seeds having a generally flat side.

16. The method of claim 15, wherein the step of sorting the seed lot based on an exterior shape of the seed includes the step of passing the seed lot through a rotating drum having a selection screen, the seeds having the generally flat side being sorted from round seeds by the generally flat side seeds passing through the screen.

17. The method of claim 12, wherein the step of capturing at least one image of an embryo region of a plurality of seeds includes the steps of:

passing the plurality of seeds through a field of view of at least one camera one at a time; and for each seed sensing when the seed is within the field of view of the at least one camera.

18. The method of claim 17, wherein the plurality of seeds are passed through a field of view of at least two cameras, for each seed a first camera being positioned to capture at least a first image of a first side of the seed and a second camera being positioned to capture a second image of a second side of the seed.

19. The method of claim 17, wherein a first seed of the plurality of seeds is supported on a transport member as the first seed is passed through the field of view of the at least one camera.

20. The apparatus of claim 1, further comprising a light to illuminate a field of view of a camera of the imaging system, the camera capturing the at least one image of the at least one seed, the light and the camera both being positioned to a first side of the at least one seed when the at least one seed is within the field of view of the camera.

21. The apparatus of claim 20, wherein the transport system includes an endless support which supports the at least one seed throughout the field of view of the camera.

22. The apparatus of claim 1, wherein the imaging system includes a camera having a field of view and the transport system includes an endless support which supports the at least one seed throughout the field of view of the camera, the camera capturing the at least one image of the at least one seed.

23. The apparatus of claim 1, wherein the visual marker is a color.

24. The method of claim 12, wherein the visual marker is a color.

25. The apparatus of claim 1, wherein the cleaning apparatus cleans the surface of the endless support while the endless support is moving.

26. The apparatus of claim 1, wherein the cleaning apparatus cleans the surface of the endless support while the endless support is supporting the at least one seed.

27. The apparatus of claim 1, wherein the cleaning apparatus cleans the surface of the endless support while the surface of the endless support is supporting the at least one seed.

* * * * *